United States Patent [19]

Vesborg

[11] 4,382,504

[45] May 10, 1983

[54] TRANSPORT AND DISPLAY CONTAINER

[75] Inventor: Steen Vesborg, Copenhagen, Denmark

[73] Assignee: Colgate-Palmolive Company, New York, N.Y.

[21] Appl. No.: 282,362

[22] Filed: Jul. 13, 1981

[30] Foreign Application Priority Data

Jul. 17, 1980 [DK] Denmark ..... 3084/80

[51] Int. Cl.[3] ..... B65D 5/52

[52] U.S. Cl. ..... 206/44 R; 206/45.22; 206/45.3; 229/23 A; 229/43

[58] Field of Search ..... 206/44 R, 45.28, 45.29, 206/45.3, 45.22; 229/16 D, 16 R, 23 R, 23 BT, 43, 23 A

[56] References Cited

U.S. PATENT DOCUMENTS

| | | | |
|---|---|---|---|
| 460,293 | 9/1891 | Lindemeyer | 229/23 A |
| 2,301,310 | 11/1942 | Messer | 206/44 R |
| 2,799,442 | 7/1957 | Van Rosen | 229/43 |
| 2,973,127 | 2/1961 | Royce | 229/43 |
| 3,058,582 | 10/1962 | Mairs | 206/44 R |
| 3,167,179 | 1/1965 | Goldstein | 229/23 BT |

*Primary Examiner*—William T. Dixson, Jr.
*Assistant Examiner*—Brenda J. Ehrhardt
*Attorney, Agent, or Firm*—Herbert S. Sylvester; Murray M. Grill; John A. Stemwedel

[57] ABSTRACT

A transport and display container for bagged powder material. The container has a lower part having a bottom and four side walls and an upper sleeve that fits over said lower part having a top and four side walls. The top is adapted to be separated from the front wall in order to permit the top panel to be raised and permit the upper sleeve to be positioned around the lower part of the container.

4 Claims, 10 Drawing Figures

TRANSPORT AND DISPLAY CONTAINER

Figure 1:
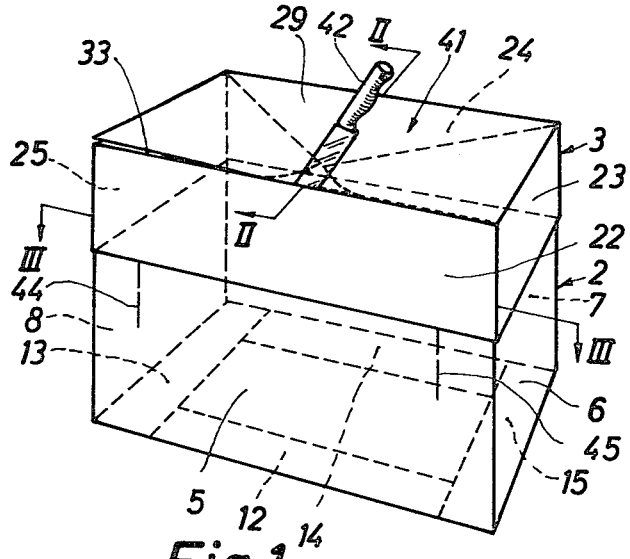

The invention relates to a transport and display container receiving a plurality of objects, e.g. bags containing powder, and which is formed by a foldable sheet material and adapted to be supported in its transport and display position by the carrying surface of a pallet, said container comprising a sleeve-like, rectangular lower part forming a front wall, a rear wall, and two side walls in the container, and which is provided with four bottom flaps extending inwards into the container from the lower edge on the front wall, the rear wall, and the two side walls, respectively, and which in the transport and display position of the container abut the carrying surface of a pallet, a plane bottom plate, the size of which corresponds to the interior cross-sectional dimensions of the lower part, and which is positioned on top of the bottom flaps within the lower part, and a rectangular upper part comprising a front wall, a rear wall, and two side walls, and a top wall assembly, and which in the transport position of the container forms a lid positioned on top of and on the outside of the lower part.

A transport and display container of this type is known, whereby the upper part serves as lid during the transport of the container. When the container after the transport is converted into a display container, the upper part has no function and may be discarded. A detachable sign is during the transport inserted in the container, and in the display position of the container said sign is put on the rear wall of the container and serves as an advertisement board.

The object of the invention is to provide a transport and display container, whereby the upper part, which serves as a lid, after the transport of the container may be used as advertising surface comprising information on the objects located in the container in the display position of the container in such a manner that a utilization of the material of the upper part is also obtained in the display position of the container.

The transport and display container according to the invention is characterized in that the top wall assembly is formed by four flaps, viz. a front flap, a rear flap, and two side flaps, whereby the front and rear flaps are connected to the upper edge of the front and rear wall, respectively, of the upper part, and whereby the two side flaps are connected to the upper edge of both side walls of the upper part, said four flaps in the transport position of the container being positioned on top of each other to form a top wall in the upper part, whereas in the display position of the container the front flap is separated from the front wall of the upper part, and the rear flap and the two side flaps are bent upwards in vertical direction in extension of the rear wall and side walls of the upper part to form a sleeve which on the outside of the lower part is lowered such a distance that the lower edge of the upper part rests on the carrying surface of the pallet, the separated front flap being located on the upper portion of the rear wall of the upper part on a level therewith. By forming the top wall assembly of the upper part in such a manner it is obtained that the upper part beyond serving as a lid in the transport position of the container also may be used as advertising surface for impression of advertising information on the objects located in the container in the display position of the container, the advertising information being located in the inner side of the four flaps of the upper part. Furthermore, a reinforcement of the lid of the container is obtained during the transport of the container since the four flaps of the upper part are partly positioned on top of each other in the transport position of the container.

According to the invention the rear flap of the upper part may along its two side edges be formed integral with the two side flaps, and the two side flaps may each comprise an oblique folding line extending from the point of intersection between the upper edges of the rear wall and side wall, respectively, of the upper part, and which forms an angle of 45° with the upper edge of the side wall of the upper part. In this manner it is obtained that when the rear flap in the transport position is bent downwards from the vertical to the horizontal position, the side flaps may easily be folded along the oblique folding lines and each form two triangular portions positioned on top of each other. Furthermore, it is obtained that the rear flap and the two side flaps in the display position of the container together form a relatively rigid U-shaped surface suitable for advertising information without using particular means for maintaining the flaps in their upwardly bent, vertical position.

Furthermore, according to the invention each side flap may be rounded at its free corner point at the end of the oblique folding line. As a result, the free corner points of the side flaps do not bump against and optionally break each other when the side flaps at folding along their folding line are bent downwards into horizontal position.

Moreover, according to the invention the front wall of the lower part may be provided with two weakening lines positioned adjacent the side edges of the front wall and extending downwards at a distance from the upper edge of the front wall, and the front wall may furthermore be provided with a longitudinal folding line parallel to the upper edge of the front wall and positioned at said distance from the upper edge. In this manner it is obtained that a pivotal flap in the display position of the container may be released along the two weakening lines in the lower part and and subsequently be swung downwards by turning about the longitudinal folding line in the front wall, whereby the inner side of the pivotal flap may serve as advertising surface. Furthermore, it is obtained that a buyer in a shop may easily reach an object in the container placed in the shop since the buyer may put his hand through the opening in the front wall of the lower part formed by swinging the pivotal flap downwards.

Furthermore, said distance may correspond to half the sum of the height of the front wall of the lower part plus the height of the pallet used. As a result the pivotal flap of the lower part may be swung 180° downwards into vertical position and cover the pallet in a length corresponding to the length of the pivotal flap.

The container may be shaped in such a manner that the bottom surface of the lower part is of a size corresponding to an entire europallet, i.e. 1200×800 mm. In this manner the standardized europallets may be used as support for the container.

Finally, the bottom surface of the lower part may be of a size corresponding to half or a third of an europallet, i.e. 600×800 mm or 400×800 mm, whereby advantageous sizes of containers are obtained, which may be used in connection with smaller europallets.

Figure 2:
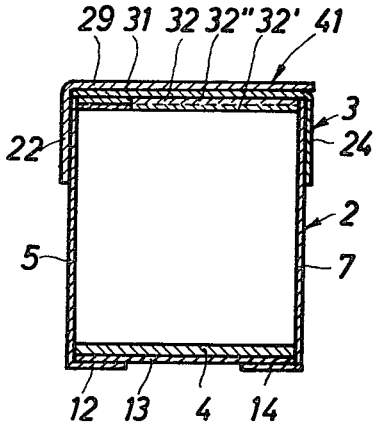
Figure 3:
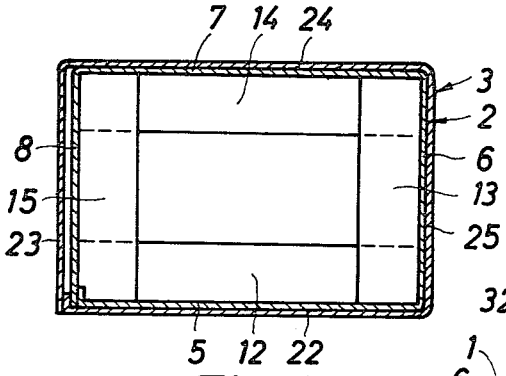
Figure 4:
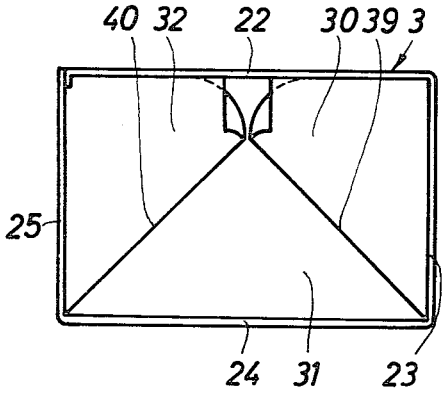
Figure 5:
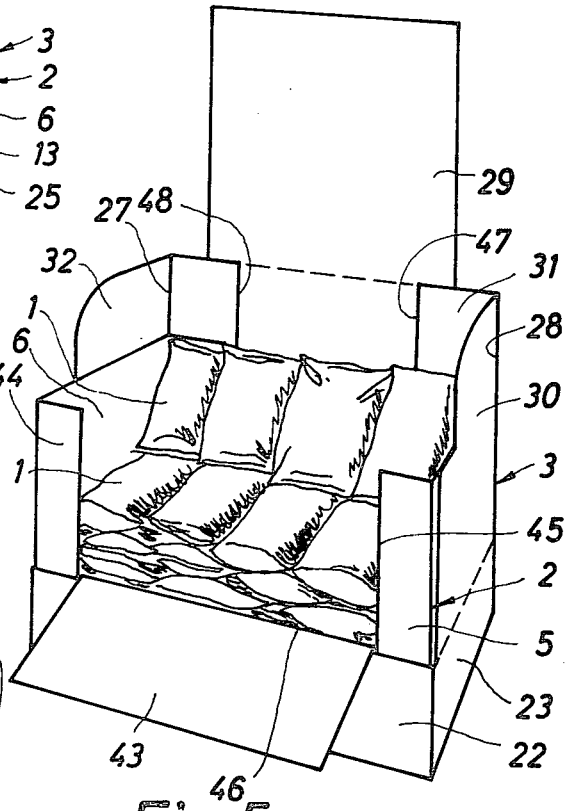
Figure 6:
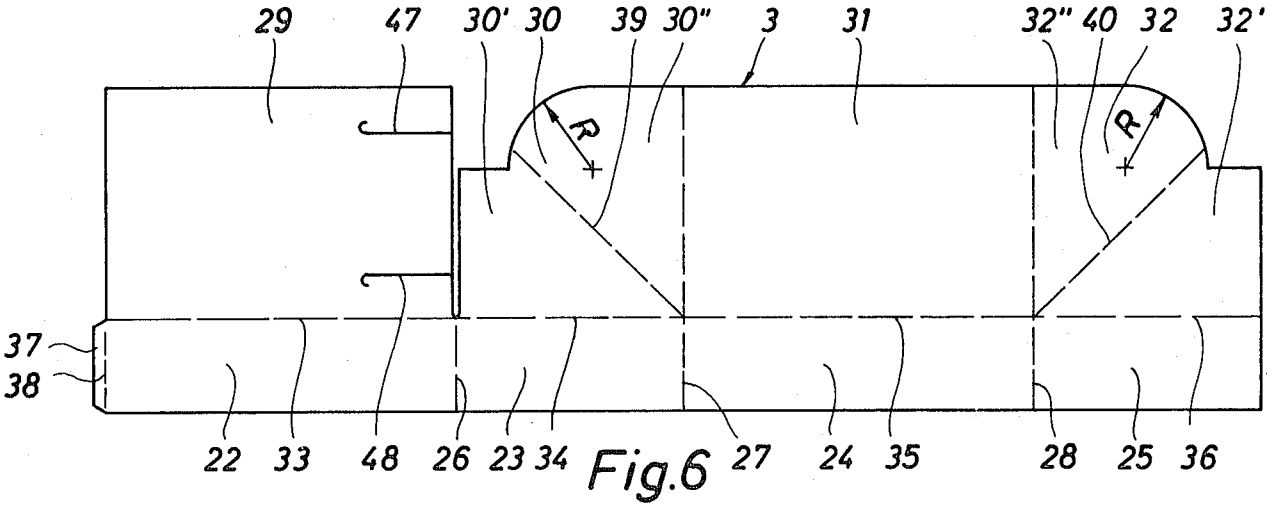
Figure 7:
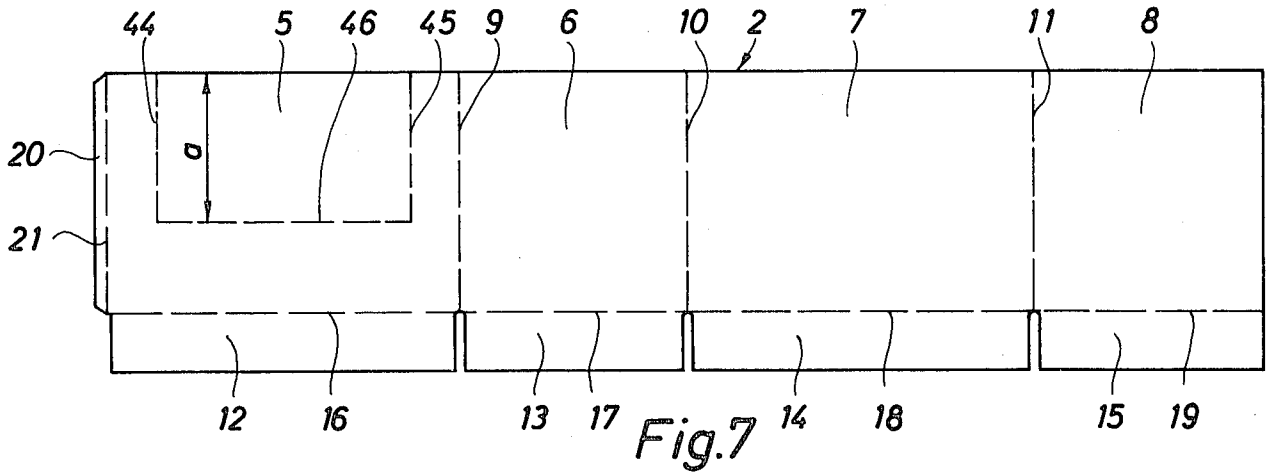
Figure 8:
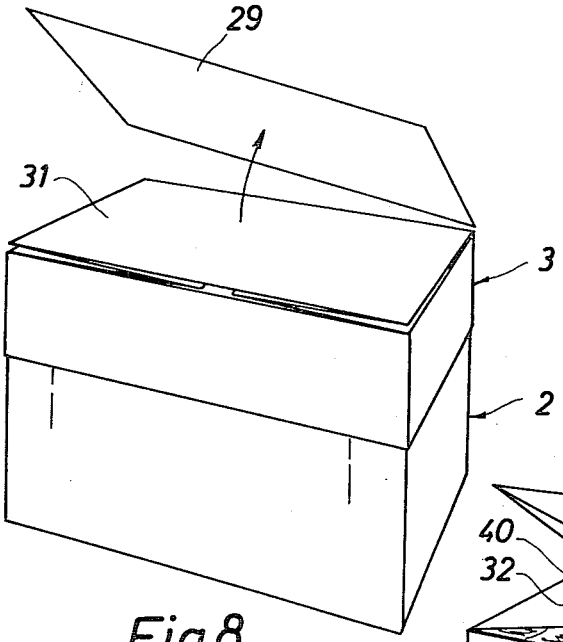
Figure 9:
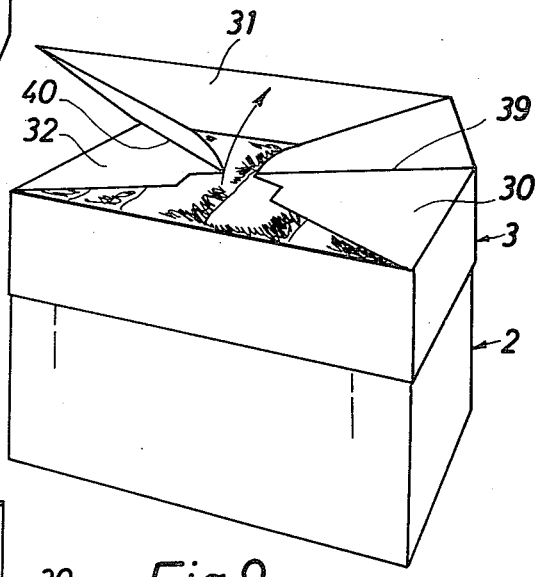
Figure 10:
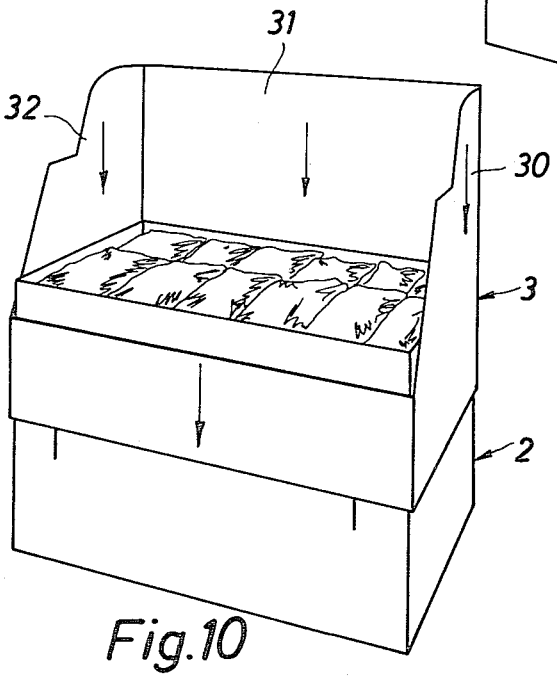

The invention will be described below with reference to the accompanying drawing, in which:

FIG. 1 is a perspective view of an embodiment of a transport and display container in its transport position, FIG. 2 is a vertical cross-sectional view through the container along the line II—II of FIG. 1, whereby hatching of cuts has been omitted for the sake of clarity, FIG. 3 is a horizontal sectional view through the upper and lower part of the container along the line III—III of FIG. 1, whereby the bottom plate in the lower part has been removed and hatching of cuts has been omitted for the sake of clarity, FIG. 4 is a bottom view of the upper part of FIG. 1, FIG. 5 is a perspective view of the container of FIG. 1 in its display position, FIG. 6 illustrates a plane, not folded blank for use of manufacturing the upper part of the container, FIG. 7 illustrates a plane, not folded blank for use of manufacturing the lower part of the container, FIG. 8 is a perspective view of the container in a first intermediary position during the conversion from the transport position into the display position, whereby the front flap of the upper part is separated from the container, FIG. 9 is a perspective view of the container in a second intermediary position, whereby the rear flap and the side flaps of the upper part have been partly raised from the horizontal position towards the vertical position, and FIG. 10 is a perspective view of the container in a third intermediary position, whereby the rear flap and the side flaps of the upper part are in vertical position and partly lowered towards the floor.

The transport and display container illustrated in FIG. 1 is in its transport position, whereas the container in FIG. 5 is illustrated in its display position. The container is adapted to be supported by a pallet not shown and to contain a number of objects 1, e.g. bags containing powder.

The container comprises a sleeve-like rectangular lower part 2, a rectangular upper part 3, and a plane bottom plate 4 (FIG. 2), said parts being manufactured of a foldable sheet material such as for instance corrugated paper or cardboard.

The lower part 2 illustrated in FIG. 1 is manufactured by folding a plane blank 2 illustrated in FIG. 7. The blank 2 comprises four rectangular panels 5, 6, 7, and 8 located beside each other and mutually connected through transverse edge folding lines 9, 10, and 11 forming a front wall 5, a side wall 6, a rear wall 7, and a second side wall 8, respectively, in the folded lower part 2 of FIGS. 1 and 3. The blank 2 furthermore comprises four bottom panels 12, 13, 14, and 15 connected to the panels 5, 6, 7, and 8, respectively, along longitudinal edge folding lines 16, 17, 18, and 19, and which form four bottom flaps 12, 13, 14, and 15 in the folded lower part 2 of FIGS. 1, 2, and 3. The panel 5 is at its side edge connected to a connecting flap 20 along a folding line 21. By folding of 90° about the transverse edge folding lines 9, 10, and 11 and 21 and the longitudinal edge folding lines 16, 17, 18 and 19 as well as by securing of the connecting flap 20 to the free side edge of the panel 8, the lower part 2 of FIG. 1 is formed.

The bottom plate 4 (FIG. 2), the size of which corresponds to the interior cross-sectional dimensions of the lower part 2, is positioned on top of the bottom flaps 12, 13, 14, and 15 within the lower part 2 and serves partly as bottom and partly to ensure the rectangular shape of the lower part 2.

The upper part 3 forms in the transport position of the container of FIG. 1 a lid positioned on top of and outside the lower part 2. The upper part 3 may be manufactured by folding a plane blank 3, see FIG. 6. The blank 3 comprises four rectangular panels 22,23, 24, and 25 located beside each other and mutually connected along transverse edge folding lines 26, 27, and 28, and which form a front wall 22, a side wall 23, a rear wall 24, and a second side wall 25, respectively, in the folded upper part 3 of FIGS. 1 and 3. The blank 3 furthermore comprises four top panels 29, 30, 31, and 32 connected to the panels 22, 23, 24 and 25 along longitudinal edge folding lines 33, 34, 25, and 36, and which form four flaps, viz. a front flap 29, a side flap 30, a rear flap 31, and a second side flap 32 in the folded upper part 3 of FIGS. 1, 2, and 4. The panel 22 is at its side edge connected to a connecting flap 37 along a folding line 38.

The top panel 30 (FIG. 6) is provided with an oblique folding line 39, which divides the top panel 30 into two triangular panels 20′ and 30″, and which extends from the point of intersection between the transverse edge folding line 27 and the longitudinal edge folding line 34 as well as forms an angle of 45° with the longitudinal edge folding line 34. In a corresponding manner the top panel 32 comprises an oblique folding line 40 dividing the top panel 32 into two triangular panels 32′ and 32″, and which extends from the point of intersection between the transverse edge folding line 28 and the longitudinal edge folding line 36 as well as forms an angle of 45° with the longitudinal edge folding line 36.

By folding of 90° about the transverse edge folding lines 26, 27, 28, and 32, the longitudinal edge folding lines 33, 34, 35, and 36, and the oblique folding lines 39 and 40 as well as by securing the connecting flap 37 to the free side edge of the panel 25, the upper part 3 of FIG. 1 is formed. In the position of the upper part 3 illustrated in FIG. 1, the four flaps 29, 30, 31, and 32 are positioned on top of each other, whereby the front flap 29 is positioned on top (FIG. 2), the rear flap 31 is positioned below said front flap, and the two side flaps 30 and 32 (FIG. 4) are positioned at the bottom. On account of the folding along the obliquie folding lines 39 and 40, these two side flaps 30 and 32 each form two triangular portions 30′ and 30″ and 32′ and 32″, respectively, located on top of each other. In this manner the four flaps form a top wall assembly or a composed top wall 41 in the upper part 3.

Below the conversion of the container from its transport position in FIG. 1 through the intermediary positions in FIGS. 8, 9, and 10 into its display position of FIG. 5 will be described. Initially the front flap 29 is released from the upper part 3 by cutting the front flap 29 free along the upper edge 33 of the upper part 3 by means of a knife 42 or a similar tool, see FIG. 1. In FIG. 8, the front flap 29 is cut free and separated from the upper part 3. Subsequently, the rear flap 31 is raised together with the side flaps 30 and 32, see FIG. 9, into a vertical position, see FIG. 10, whereby the upper part 3 is shaped as a sleeve or cover. Then the upper part 3 is displaced or lowered as far as possible downwards towards the floor, i.e. towards the carrying surface of a supporting pallet. In FIG. 5 the upper part 3 has been displaced completely downwards in such a manner that the lower edge of the upper part rests against the carrying surface of the pallet not shown. Finally, a pivotal flap 43 in the front wall 5 of the lower part is released along two weakening lines 44 and 45 (FIGS. 1, 5, and 7) provided in the front wall 5, said pivotal flap 43 being swung downwards to the floor about a longitudinal folding line 46 (FIGS. 5 and 7) also provided in the front flap 29 is located on the rear flap 31 of the upper part 3, whereby the front flap 29 for instance is secured to the rear flap 31 by means of two parallel slots 47 and 48 provided in the front flap 29, the side of the front flap 29, which in the transport position of the container turned inwards and thus was protected against external influences towards the container, now turning forwards towards the front wall 5 of the lower part in the display position of the container illustrated in FIG. 5.

By means of the above structure of the top wall assembly 41 of the upper part 3, which is formed by the four flaps 29, 30, 31, and 32, it is obtained that the upper part 3 beyond serving as a lid in the transport position in FIG. 1 of the container also may be used as advertising surface for impression of advertising information on the objects 1 located in the container in the display position in FIG. 5 of the container since the advertising information may be located on the inner side of the four flaps 29, 30, 31, and 32 of the upper part 3 in the transport position (FIGS. 1 and 2) of the container are positioned partly on top of each other to form a composed plate.

As illustrated in FIGS. 5 and 6, the rear flap 31 of the upper part 3 is along its two side edges 27 and 28 formed integral with the two side flaps 30 and 32. As a result, the rear flap 31 and the two side flaps 30 and 32 in the display position (FIG. 5) of the container form together a relatively rigid U-shaped surface suitable for advertising information without using particular means for maintaining said flaps in their upwardly bent, vertical position.

As illustrated in FIGS. 5 and 6, each side flap 30 and 32 is rounded at its free corner point at the end of the oblique folding line 39, 40, respectively. In this manner it is obtained that the free corner points of the side flaps 30 and 32 do not bump against each other when the side flaps 30 and 32 at folding along their oblique folding line 39, 40, respectively, are bent downwards into horizontal position in the transport position (FIGS. 1, 3, and 4) of the container. This rounding of the side flaps 30 and 32 is for instance a quarter of an arc of a circle with the radius R, see FIG. 6.

By using the pivotal flap 43 illustrated in FIG. 5 it is obtained that the inner side of the pivotal flap 43 may serve as advertising surface. Furthermore, it is obtained that a buyer in a shop may easily reach an object 1 in the container placed in the shop, as the buyer may only put his hand through the opening in the front wall 5 of the lower part 2 formed by swinging downwards the pivotal flap 43.

The height of the pivotal flap 43, i.e. the distance a (FIG. 7) between the longitudinal folding line 46 and the upper edge of the front wall 5, corresponds preferably to half the sum of the height of the front wall 5 of the lower part plus the height of the pallet used. As a result, the pivotal flap 43 of the lower part may be swung 180° downwards into vertical position and cover the pallet in a length corresponding to the length of the pivotal flap 43. In FIG. 5, the pivotal flap 43 is in an oblique position, but may be swung downwards completely into vertical position when the container is located on a pallet.

The bottom surface of the lower part 2 may for instance be of a size corresponding to an entire europallet, i.e. 1200×800 mm. As a result, the standardized europallets may be used as support for the container.

Furthermore, the bottom surface of the lower part 2 may be of a size corresponding to half or a third of an europallet, of a size corresponding to half or a third of an europallet, i.e. 600×800 mm or 400×800 mm. In this manner advantageous sizes of containers are obtained, which may be used in connection with smaller europallets.

Instead of the weakening lines 44 and 45, in advance provided slots (cuts provided through knives) may be provided in such a manner that the pivotal flap 43 may immediately be swung downwards into vertical position.

It should be noted, that the upper part 3 is telescopically located on the lower part 2 in the transport position (FIG. 1) of the container, so that the upper part 3 may be displaced downwards as the objects, e.g. bags containing powder, sink downwards in the container.

Should it not be desired to utilize the advertising surface of the front flap 39, the surfaces 30 and 32 and the surface between the edges 27 and 28 may be used as advertising surface along (FIG. 5).

The embodiments of the invention in which an exclusive property or privilege is claimed are defined as follows:

I claim:

1. A transport and display container adapted to receive plurality of objects, and which is formed by a foldable sheet material and adapted to be supported in its transport and display position by the carrying surface of a pallet, said container comprising a sleeve-like, rectangular lower part forming a front wall, a rear wall, and two side walls in the container, and which is provided with four bottom flaps extending inwards into the container from the lower edge on said front wall, said rear wall, and two side walls, respectively, and which in the transport and display position of the container abut the carrying surface of a pallet, a plane bottom plate, the size of which corresponds to the interior cross-sectional dimensions of said lower part, and which is positioned on top of said four bottom flaps within said lower part, and a rectangular upper part comprising a front wall, a rear wall, and two side walls, and a top wall assembly, and which in the transport position of the container forms a lid positioned on top of and on the outside of said lower part characterized in that said top wall assembly is formed by a front flap connected to the upper edge of said front wall of said upper part, two side flaps connected to the upper edges of said side walls of said upper part, and a rear flap connected to the upper edge of said rear wall of said upper part and which is formed along its two side edges integral with said two side flaps, said two side flaps each containing an oblique folding line extending from the point of intersection between the upper edges of said rear wall and said side wall, respectively, of said upper part, and which forms an angle of 45° with the upper part of said side wall, said four flaps of the top wall assembly in the transport position of the container being positioned on top of each other to form a top wall in said upper part.

2. A container as claimed in claim 1, characterized in that each said side flap is rounded at its free corner point at the end of said oblique folding line.

3. A container as claimed in claim 1, characterized in that said front wall of said lower part is provided with two weakening lines positioned adjacent the side edges of said front wall and extending downwards at a distance from the upper edge of said front wall, and that said front wall furthermore is provided with a longitudinal folding line parallel to the upper edge of said front wall and positioned at said distance from the upper edge.

4. A container as claimed in claim 3, characterized in that said distance corresponds to half the sum of the height of said front wall of said lower part plus the height of the pallet used.

* * * * *